US011873606B2

(12) United States Patent
Hattori et al.

(10) Patent No.: US 11,873,606 B2
(45) Date of Patent: Jan. 16, 2024

(54) NAPPED ARTIFICIAL LEATHER AND METHOD FOR PRODUCING SAME

(71) Applicant: KURARAY CO., LTD., Kurashiki (JP)

(72) Inventors: Hiroyuki Hattori, Okayama (JP); Yasuhiro Katou, Okayama (JP); Kazuyuki Suetoshi, Okayama (JP); Rei Nagayama, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 246 days.

(21) Appl. No.: 17/298,124

(22) PCT Filed: Dec. 10, 2019

(86) PCT No.: PCT/JP2019/048191
§ 371 (c)(1),
(2) Date: May 28, 2021

(87) PCT Pub. No.: WO2020/129741
PCT Pub. Date: Jun. 25, 2020

(65) Prior Publication Data

US 2022/0049417 A1 Feb. 17, 2022

(30) Foreign Application Priority Data

Dec. 21, 2018 (JP) ..... 2018-239314

(51) Int. Cl.
*D06N 3/14* (2006.01)
*D06N 3/00* (2006.01)

(52) U.S. Cl.
CPC ..... *D06N 3/0075* (2013.01); *D06N 3/0011* (2013.01); *D06N 3/0077* (2013.01);
(Continued)

(58) Field of Classification Search
CPC ..... D06N 3/0004; D06N 3/0011; D06N 3/0075; D06N 3/14; D06N 2209/0823; D01F 1/04
See application file for complete search history.

(56) References Cited

U.S. PATENT DOCUMENTS 4,046,504 A 9/1977 Fukushima
2005/0118394 A1* 6/2005 Tanaka ..... D06N 3/0004 442/268

(Continued)

FOREIGN PATENT DOCUMENTS

EP 1403421 A2 3/2004
EP 1403421 A3 3/2004

(Continued)

OTHER PUBLICATIONS

International Search Report dated Mar. 17, 2020 in PCT/JP2019/048191 (with English translation), 5 pages.

(Continued)

*Primary Examiner* — Larissa Rowe Emrich
(74) *Attorney, Agent, or Firm* — Element IP, PLC

(57) ABSTRACT

Disclosed is a napped artificial leather napped including: a non-woven fabric that is an entangle body of ultrafine fibers; and an elastic polymer impregnated into the non-woven fabric, the napped artificial leather having, at least on one side thereof, a napped surface formed by napping the ultrafine fibers, wherein the ultrafine fibers contain 0.5 mass % or more of a pigment (A), the elastic polymer contains 0 to 0.01 mass % of a pigment (B), and the ultrafine fibers and the elastic polymer are undyed; the napped surface has a lightness L* value of 25 or less in a color coordinate space (L*a*b* color space); and a ratio of an area occupied by the elastic polymer, observed on the napped surface, to a total area of an area occupied by the ultrafine fibers and the area occupied by the elastic polymer is 0.5% or less.

9 Claims, 1 Drawing Sheet

(52) U.S. Cl.
CPC ..... *D06N 3/14* (2013.01); *D06N 2201/0209* (2013.01); *D06N 2205/023* (2013.01); *D06N 2209/0823* (2013.01); *D06N 2211/106* (2013.01); *D06N 2211/14* (2013.01); *D06N 2211/263* (2013.01); *D06N 2211/28* (2013.01)

(56) References Cited

U.S. PATENT DOCUMENTS

| | | | | |
|---|---|---|---|---|
| 2009/0047476 | A1* | 2/2009 | Meguro | D06N 3/0004 428/151 |
| 2009/0075018 | A1 | 3/2009 | Ashida et al. | |
| 2010/0105265 | A1 | 4/2010 | Ueno et al. | |
| 2011/0070422 | A1* | 3/2011 | Ammirati | D06N 3/14 428/297.4 |
| 2020/0071879 | A1 | 3/2020 | Meguro | |

FOREIGN PATENT DOCUMENTS

| | | | |
|---|---|---|---|
| JP | S55-504 | B2 | 1/1980 |
| JP | 2001279532 | A | 10/2001 |
| JP | 2002146624 | A | 5/2002 |
| JP | 2004143654 | A | 5/2004 |
| JP | 2007291565 | A | 11/2007 |
| JP | 2012046849 | A | 3/2012 |
| JP | 2014139361 | A | 7/2014 |
| KR | 1020010073891 | A | 8/2001 |
| WO | WO-2006095621 | A1 | 9/2006 |
| WO | WO-2008126610 | A1 | 10/2008 |
| WO | WO-2018230417 | A1 | 12/2018 |

OTHER PUBLICATIONS

Extended European Search Report dated Aug. 22, 2022 in Patent Application No. 19899044.2, 10 pages.

* cited by examiner

NAPPED ARTIFICIAL LEATHER AND METHOD FOR PRODUCING SAME

CROSS-REFERENCE TO RELATED APPLICATIONS

This application is the U.S. National Stage of International Application No. PCT/JP2019/048191, filed Dec. 10, 2019. This application claims priority to Japanese Patent Application No. 2018-239314, filed Dec. 21, 2018.

TECHNICAL FIELD

The present invention relates to a napped artificial leather that has a suede-like napped surface and that can be suitably used as a surface material for clothing, shoes, articles of furniture, car seats, and general merchandise, and the like. More particularly, the invention relates to a napped artificial leather having a dark color napped surface that is uniform in color and gloss and has a calm impression.

BACKGROUND ART

Napped artificial leathers having an suede-like appearance have a napped surface formed by raising ultrafine fibers on the surface thereof by napping the surface of an artificial leather gray fabric obtained by impregnating an elastic polymer into voids of a non-woven fabric of ultrafine fibers.

Most of the conventional napped artificial leathers have been dyed with a dye. When a napped artificial leather is dyed, the color development of ultrafine fibers and the color development of an elastic polymer tend to differ because the dyeability of the dye to the ultrafine fibers is higher than the dyeability of the dye to the elastic polymer. In particular, when a napped artificial leather is dyed in a dark color, the color of the ultrafine fibers is relatively dark, and the color of the elastic polymer is relatively bright. Consequently, spot-like color irregularities occur on the napped surface, resulting in an appearance that is uneven in color or gloss and has no calm impression, which is also called a "glitteringly shining" appearance. Such glittering is not favored by consumers, and results in a reduced product quality.

Methods for suppressing the glittering are known in which the ultrafine fibers are colored by blending a pigment therein, or the elastic polymer is colored by blending a pigment therein. Specifically, for example, PTL 1 listed below discloses an artificial leather including spun-dyed ultrafine fibers containing 1 to 30 wt % of carbon black having an average primary particle size of 10 to 50 nm and a dibutyl phthalate (DBP) oil adsorption of 30 to 600 $cm^3/100$ g, relative to the weight of the fibers. PTL 2 listed below describes that a leather-like sheet material is a composite of a plurality of types of polymeric materials that differ in properties, and therefore the differences in properties such as color fastness between the polymeric materials lead to problems such as difficulty in color development into a dark color, creation of a heterochromatic impression, and a poor color development. Also, in order to solve such problems, a method is disclosed in which a pigment is added to a rubber elastic polymeric material.

CITATION LIST

Patent Literatures

[PTL 1] Japanese Examined Patent Publication No. 55-00504

[PTL 2] Japanese Laid-Open Patent Publication No. 2002-146624

SUMMARY OF INVENTION

Technical Problem

It is known that in the case of using fibers colored with a pigment (also referred as spun-dyed fibers), the color tone can be adjusted to the desired color tone with a dye by performing dyeing processing even when an elastic polymer that is not colored with a pigment is used. However, the elastic polymer that is not colored with a pigment becomes whitish even if it is dyed. Accordingly, when a napped surface is to be colored in a dark black color, a dichromatic impression is created due to the difference in color tone between the dark color of the spun-dyed fibers and the whitish color of the elastic polymer, so that only a dark color napped artificial leather that lacks elegance or a high-quality impression can be obtained. In addition, there is the problem that, if the napped artificial leather is dyed with a large amount of dye in order to solve this problem, the fastness of the napped artificial leather is reduced although the dichromatic impression due to the difference in color tone between the dark color of the spun-dyed fiber and the whitish color of the elastic polymer is reduced.

As disclosed in PTL 2, a method is also proposed in which an elastic polymer that has been colored with a pigment in advance is added to a fiber assembly composed of spun-dyed fibers, thus reducing the heterochromatic impression between the spun-dyed fibers and the elastic polymer. However, artificial leathers are often industrially required to be produced under multiple brands in small quantities. For this reason, when an elastic polymer that has been colored with a pigment is used to produce artificial leathers under multiple brands in small quantities, the color is adjusted for each brand, so that there is a need for an operation of producing artificial leathers while switching the concentrations of the pigment, resulting in reduced productivity. In addition, the color development of the elastic polymer may be higher than that of the spun-dyed fibers, and a dichromatic impression may be created due to the difference in color tone between the color of the spun-dyed fibers and the color of the elastic polymer. In such a case, it is conceivable to eliminate the dichromatic impression by adjusting the color through dyeing as disclosed in PTL 2. However, there is the problem that the color adjustment through dyeing is difficult when an elastic polymer that has been colored with a pigment in advance is used.

It is an object of the present invention to provide a dark color napped artificial leather that is excellent in term of the above-described problems, or in other words, excellent in productivity, and is less likely to create a dichromatic impression on a napped surface thereof, without using dyeing that could reduce the fastness.

Solution to Problem

An aspect of the present invention is directed to a napped artificial leather including: a non-woven fabric that is an entangle body of ultrafine fibers; and an elastic polymer impregnated into the non-woven fabric, the napped artificial leather having, at least on one side thereof, a napped surface formed by napping the ultrafine fibers, wherein the ultrafine fibers contain 0.5 mass % or more of a pigment (A), the elastic polymer contains 0 to 0.01 mass % of a pigment (B), and the ultrafine fibers and the elastic polymer are undyed;

the napped surface has a lightness L* value of 25 or less in a color coordinate space (L*a*b* color space); and a ratio of an area occupied by the elastic polymer, observed on the napped surface, to a total area of an area occupied by the ultrafine fibers and the area occupied by the elastic polymer is 0.5% or less. The present inventors aimed to inhibit the process contamination due to contamination of a coloring component by using a substantially uncolored elastic polymer when a dark color napped artificial leather is required to be produced under multiple brands in small quantities, thus omitting an operation of switching the concentrations of a pigment in an emulsion. Also, the inventors found that the operation of switching the concentrations of the pigment could be omitted when the elastic polymer contains 0 to 0.01 mass % of the pigment (B), for which coloration was substantially visually unrecognizable. Furthermore, the inventors found that the glittering was more likely to be sensed when a substantially uncolored, pale color or bright color elastic polymer was exposed over a certain area or more of the napped surface of a dark color napped artificial leather. Then, the inventors found that a dark color napped artificial leather that was less likely to cause the glittering could be obtained when the ratio of the area occupied by the elastic polymer to a total area of the area occupied by ultrafine fibers and the area occupied by the elastic polymer was set to 0.5% or less. Also, in such a dark color napped artificial leather, the elastic polymer is less exposed, so that it is also possible to omit the color adjustment through dyeing.

It is preferable that the ultrafine fibers contain 0.5 to 10 mass % of the pigment (A), because a napped artificial leather including a dark color napped surface having a lightness L* value of 25 or less can be easily obtained by the color development of only the pigment (A) in the ultrafine fibers.

It is preferable that the napped artificial leather includes 0.1 to 15% of the elastic polymer, because the ratio of the area occupied by the elastic polymer observed on the napped surface can be easily adjusted to 0.5% or less.

Another aspect of the present invention is directed to a method for producing any one of the above-described napped artificial leathers, including at least the steps of: preparing a first non-woven fabric that is an entangle body of ultrafine fiber-generating fibers for forming the ultrafine fibers containing 0.5 mass % or more of the pigment (A); fully impregnating, into voids of the first non-woven fabric, an emulsion for forming the elastic polymer containing 0 to 0.01 mass % of the pigment (B), and subsequently removing a part of the emulsion by squeezing off; solidifying the elastic polymer in the emulsion applied into the voids of the first non-woven fabric; forming the ultrafine fibers from the ultrafine fiber-generating fibers to form an artificial leather gray fabric including a second non-woven fabric that is an entangle body of the ultrafine fibers; and buffing at least one side of the artificial leather gray fabric, wherein a squeezing rate at which a part of the emulsion is squeezed off is 30 to 50%. With such a production method, the above-described napped artificial leathers can be easily obtained.

Advantageous Effects of Invention

According to the present invention, it is possible to obtain a dark color napped artificial leather that is excellent in productivity and is less likely to create a dichromatic impression on a napped surface thereof, without using dyeing that could reduce the fastness.

DESCRIPTION OF EMBODIMENT

A napped artificial leather according to the present embodiment is a napped artificial leather including: a non-woven fabric that is an entangle body of ultrafine fibers; and an elastic polymer impregnated into the non-woven fabric, the napped artificial leather having, at least on one side thereof, a napped surface formed by napping the ultrafine fibers, wherein the ultrafine fibers contain 0.5 mass % or more of a pigment (A), the elastic polymer contains 0 to 0.01 mass % of a pigment (B), and the ultrafine fibers and the elastic polymer are undyed; the napped surface has a lightness L* value of 25 or less in a color coordinate space (L*a*b* color space); and a ratio of an area occupied by the elastic polymer, observed on the napped surface, to a total area of an area occupied by the ultrafine fibers and the area occupied by the elastic polymer is 0.5% or less.

Figure 1:
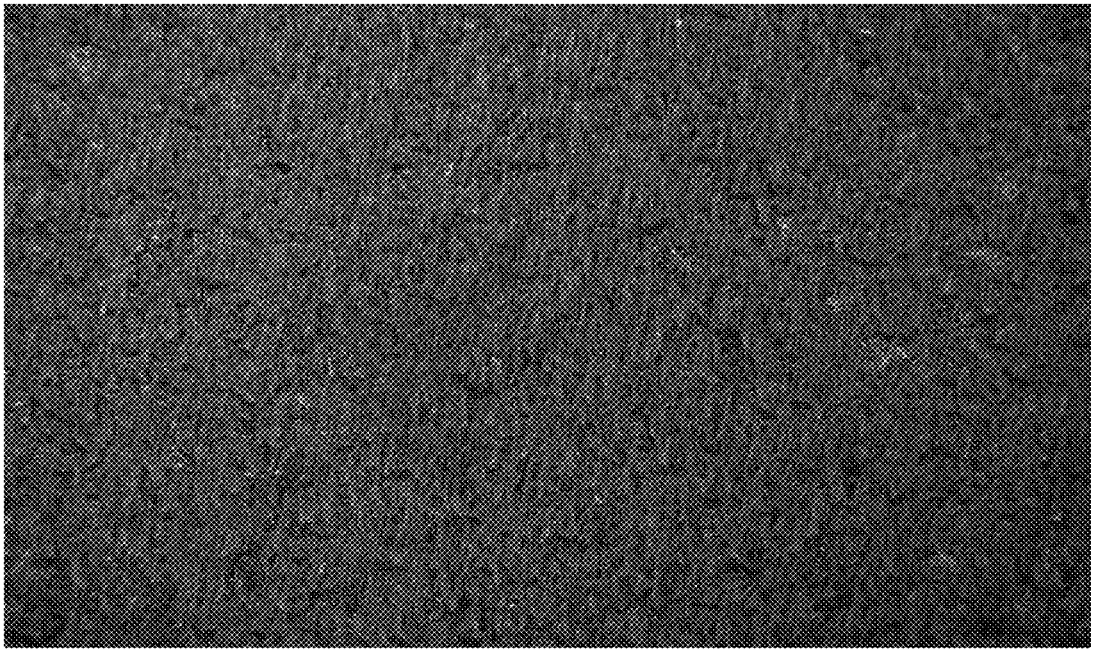
FIG. 1 is a photograph of a napped surface of an example of a napped artificial leather according to the present invention, taken at a magnification of 20× using a digital microscope, the napped artificial leather including a napped surface in which the ratio of an area occupied by an elastic polymer is 0.22%.
Figure 2:
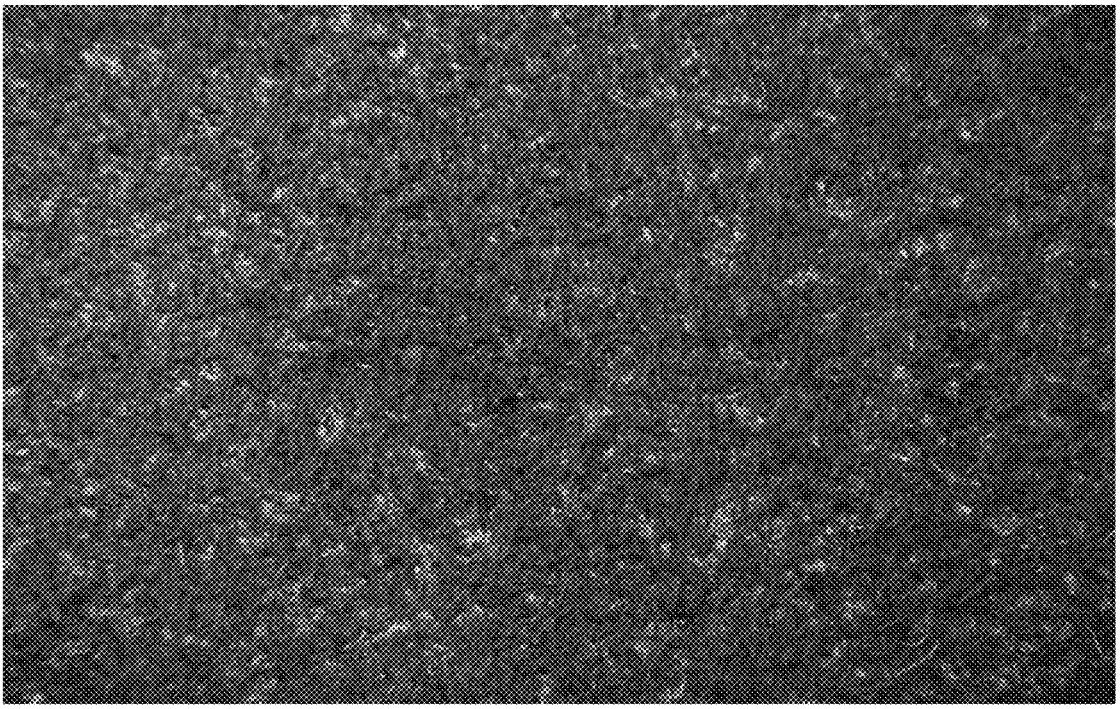
FIG. 2 is a photograph of a napped surface of an example of a conventional napped artificial leather, taken at a magnification of 20× using a digital microscope, the napped artificial leather including a napped surface in which the ratio of an area occupied by an elastic polymer is 0.86%.

An outline of the napped artificial leather according to the present embodiment will be described with reference to photographs as substitutes for drawings. FIG. 1 is a photograph of a napped surface of an example of a napped artificial leather according to the present invention, taken at a magnification of 20× using a digital microscope, the napped artificial leather including a napped surface in which the ratio of an area occupied by an elastic polymer is 0.22%. FIG. 2 is a photograph of a napped surface of an example of a conventional napped artificial leather, taken at a magnification of 20× using a digital microscope, the napped artificial leather including a napped surface in which the ratio of an area occupied by an elastic polymer is 0.86%.

As shown in FIG. 2, a large amount of an elastic polymer is exposed on the napped surface of the conventional napped artificial leather. The elastic polymer present on such a napped surface has a high brightness, and creates a dichromatic impression on the napped surface. On the other hand, as shown in FIG. 1, an elastic polymer having a high brightness is exposed in a small amount or not exposed on the napped surface of the napped artificial leather according to the present invention. Accordingly, only the color of the ultrafine fibers colored in a dark color is easily visually recognized from the napped surface, and therefore no dichromatic impression is created on the napped surface.

The ratio of the area occupied by the elastic polymer, observed on the napped surface, to a total area of the area occupied by the ultrafine fibers and the area occupied by the elastic polymer is determined as follows. An image of a napped surface that has been brushed in the grain direction using a lint brush is photographed in a range of 12 mm long by 16 mm wide at a magnification of 20× using a digital microscope, then the resulting image is subjected to binarized image analysis, to obtain the area occupied by the dark color region formed by the ultrafine fibers and the area occupied by the bright color region formed by the uncolored elastic polymer, and the ratio of the area occupied by the bright color region to the total area is obtained as the ratio of the area occupied by the elastic polymer. Note that the ratio is an average value of five locations when the napped surface was evenly photographed.

In the napped artificial leather according to the present embodiment, the ratio of the area occupied by the elastic polymer to a total area of the area occupied by the ultrafine fibers and the area occupied by the elastic polymer is preferably 0.5% or less, and more preferably 0.4% or less, because a dark color napped artificial leather that is less likely to create a dichromatic impression on the napped surface can be obtained. When the above-described ratio of the area occupied by the elastic polymer exceeds 0.5%, a dichromatic impression is created on the napped surface of the dark color napped artificial leather, and the glittering is likely to be sensed.

Note that even in the case where the elastic polymer having a high brightness is hardly observed on the napped surface of the napped artificial leather, as a result of which only the color of the ultrafine fibers colored in a dark color is visually recognized, and no dichromatic impression is created in the napped surface, the ratio of the area occupied by the elastic polymer to a total area of the area occupied by the ultrafine fibers and the area occupied by the elastic polymer is usually 0.01% or more. This is because some of the napped fibers diffusely reflect light during photographing of the napped surface, and are thus determined as a bright color region on a binarized analysis image.

The dark color napped artificial leather as described above will be described in further detail with reference to an example of the production method thereof.

The napped artificial leather according to the present embodiment is produced, for example, by a production method, including at least the steps of: preparing a first non-woven fabric that is an entangle body of ultrafine fiber-generating fibers for forming the ultrafine fibers containing 0.5 mass % or more of the pigment (A); fully impregnating, into voids of the first non-woven fabric, an emulsion for forming the elastic polymer containing 0 to 0.01 mass % of the pigment (B), and subsequently removing a part of the emulsion by squeezing off; solidifying the elastic polymer in the emulsion applied into the voids of the first non-woven fabric; forming the ultrafine fibers from the ultrafine fiber-generating fibers to form an artificial leather gray fabric including a second non-woven fabric that is an entangle body of the ultrafine fibers; and buffing at least one side of the artificial leather gray fabric, wherein a squeezing rate at which a part of the emulsion is squeezed off is 30 to 50%.

First, a description will be given of the step of preparing a first non-woven fabric that is an entangle body of ultrafine fiber-generating fibers for forming the ultrafine fibers containing 0.5 mass % or more of the pigment (A).

Examples of the production method of the first non-woven fabric that is an entangle body of ultrafine fiber-generating fibers include a method in which ultrafine fiber-generating fibers such as island-in-the-sea (matrix-domain) composite fibers are melt-spun to produce a web, and the web is subjected to entangling. In the present embodiment, a case where a first non-woven fabric obtained by entangling island-in-the-sea composite fibers is formed will be described in detail as a representative example. Note that as the ultrafine fiber-generating fibers, strip/division-type composite fibers or the like may be used in place of island-in-the-sea composite fibers.

Examples of the method for producing the web of island-in-the-sea composite fibers include a method in which island-in-the-sea composite fibers of filaments that have been spun by spunbonding or the like are collected on a net without being cut, to form a filament web, and a method in which filaments that have been melt-spun are cut into staples to form a staple web. Among these, it is particularly preferable to use a filament web in that the entangled state can be easily adjusted and a high level of fullness can be achieved. In addition, the formed web may be fusion bonded in order to impart shape stability thereto. In any of the processes until the sea component of the island-in-the-sea composite fibers is removed to form ultrafine fibers, fiber shrinking such as heat shrinking using water vapor or hot water, or dry-heating may be performed to densify the island-in-the-sea composite fibers.

Note that the filament means a continuous fiber, rather than a staple that has been intentionally cut after being spun. Specifically, the filament means a filament or a continuous fiber other than a staple that has been intentionally cut so as to have a fiber length of about 3 to 80 mm, for example. The fiber length of the island-in-the-sea composite fibers before being subjected to the ultrafine fiber generation is preferably 100 mm or more, and may be several meters, several hundred meters, several kilometers, or more, as long as the fibers are technically producible and are not inevitably cut during the production processes.

The type of the resin for the island component in the island-in-the-sea composite fibers is not particularly limited. Specific examples thereof include fibers of aromatic polyesters such as polyethylene terephthalate (PET), modified PETs such as isophthalic acid-modified PET and sulfoisophthalic acid-modified PET, cationic dye-dyeable modified PET, polybutylene terephthalate, and polyhexamethylene terephthalate; aliphatic polyesters such as polylactic acid, polyethylene succinate, polybutylene succinate, polybutylene succinate adipate, and a polyhydroxybutyrate-polyhydroxyvalerate resin; nylons such as nylon 6, nylon 66, nylon 10, nylon 11, nylon 12, and nylon 6-12; and polyolefins such as polypropylene, polyethylene, polybutene, polymethylpentene, and a chlorine-based polyolefin.

In the production method of the napped artificial leather according to the present embodiment, 0.5 mass % or more of the pigment (A) is blended in the resin for the island component in order to form ultrafine fibers colored in a dark color. The pigment (A) is a dark color pigment, and specific examples thereof include dark color pigments such as inorganic pigments, including, for example, black pigments such as carbon black and ketjen black; blue pigments such as ultramarine blue and Prussian blue (ferric potassium ferrocyanide); red pigments such as red lead and iron oxide red; and yellow pigments such as chrome yellow and zinc yellow (zinc yellow type 1, zinc yellow type 2), and organic pigments, including, for example, condensed polycyclic organic pigments of various colors such as a phthalocyanine-based pigment, an anthraquinone-based pigment, a quinacridone-based pigment, a dioxazine-based pigment, an isoindolinone-based pigment, an isoindoline-based pigment, an indigo-based pigment, a quinophthalone-based pigment, a diketopyrrolopyrrole-based pigment, a perylene-based pigment, and a perinone-based pigment; and insoluble azo-based organic pigments such as a benzimidazolone-based pigment, a condensed azo-based pigment, and an azomethine azo-based pigment.

The content ratio of the pigment (A) in the formed ultrafine fibers is not particularly limited, as long as it is 0.5 mass % or more, and is an amount that can achieve the desired color development. Specifically, the content ratio is preferably 0.5 to 10 mass %, and more preferably 1.5 to 7 mass %, because a napped artificial leather having a dark color with a lightness L* value of 25 or less can be easily obtained. In addition to the pigment (A), the ultrafine fibers may contain an ultraviolet absorber, a heat stabilizer, a deodorant, an antifungal agent, various other stabilizers, and the like as needed.

As the resin for the sea component of the island-in-the-sea composite fibers, a polymer having higher solubility in a solvent or higher decomposability by a decomposition agent than the resin for the island component is selected. Also, a polymer having low affinity for the island component polymer and a smaller melt viscosity and/or surface tension under the spinning condition than the island component polymer is preferable in terms of the excellent stability in spinning of the island-in-the-sea composite fibers. Specific examples of such a resin for the sea component include a water-soluble polyvinyl alcohol-based resin (water-soluble PVA), polyethylene, polypropylene, polystyrene, an ethylene-propylene-based copolymer, an ethylene-vinyl acetate-based copolymer, a styrene-ethylene-based copolymer, and a styrene-acrylic copolymer. Among these, the water-soluble PVA is preferable in that it can be removed by dissolution using an aqueous medium without using an organic solvent and thus has a low environmental load.

The fineness of the island-in-the-sea composite fibers is not particularly limited. An average area ratio between the sea component and the island component on the cross section of the island-in-the-sea composite fiber is preferably 5/95 to 70/30, more preferably 10/90 to 50/50. The number of domains of the island component on the cross section of the island-in-the-sea composite fiber is not particularly limited, but is preferably about 5 to 1000, more preferably about 10 to 300, from the viewpoint of the industrial productivity.

Examples of the entangling include a method in which the web was laid in a plurality of layers in the thickness direction using a cross lapper or the like, and subsequently the web is needle punched simultaneously or alternately from both surfaces such that at least one barb penetrates the web, or the web is subjected to entangling by high-pressure water jetting. Note that an oil solution, an antistatic agent, and the like may be added to the web in any stage from the spinning step to the entangling of the island-in-the-sea composite fibers.

Then, if necessary, fiber shrinking such as heat shrinking using water vapor or hot water, or dry-heating, or hot pressing is performed on the entangled web to adjust the entangled state and the smoothed state of the web, whereby a non-woven fabric of the island-in-the-sea composite fibers can be obtained as the first non-woven fabric that is an entangle body of the ultrafine fiber-generating fibers.

Next, a description will be given of the step of fully impregnating, into voids of the first non-woven fabric, an emulsion for forming the elastic polymer containing 0 to 0.01 mass % of the pigment (B), and subsequently removing a part of the emulsion by squeezing off.

In the present step, an emulsion for forming the elastic polymer containing 0 to 0.01 mass % of the pigment (B) is fully impregnated so as to occupy the entire volume of the voids in the non-woven fabric of the island-in-the-sea composite fibers, and subsequently roll-nip treatment, for example, is performed to squeeze off the emulsion such that the squeezing rate is 30 to 50%.

Specific examples of the elastic polymer include polyurethanes, acrylonitrile elastomers, olefin elastomers, polyester elastomers, polyamide elastomers, and acrylic elastomers. Among these, polyurethanes are preferable. In order to prevent any influence due to contamination of the coloring component being imposed on processes, the elastic polymer may contain the pigment (B) in a range that does not substantially color the elastic polymer, specifically, 0 to 0.01 mass %. Specific examples of the pigment (B) include carbon black, titanium oxide, zinc white, molybdenum red, Prussian blue, cobalt blue, an azo pigment, a phthalocyanine pigment, a quinacridone pigment, an isoindoline pigment, a threne-based pigment, and a perylene pigment.

The content ratio of the pigment (B) in the elastic polymer is 0 to 0.01 mass %, and it is preferable that the elastic polymer does not substantially contain the pigment (B) such that the content ratio is preferably 0 to 0.005 mass %, and more preferably 0 mass %, because an influence of the contamination of the coloring component is less likely to be imposed on processes since the elastic polymer is not substantially colored. When the content ratio of the pigment (B) in the elastic polymer exceeds 0.01 mass %, the pigment (B) may remain to such an extent that an influence of the contamination of the coloring component is imposed on processes. In such a case, the productivity tends to be reduced when the artificial leather is produced under multiple brands in small quantities.

In the emulsion of the elastic polymer, a coagulation regulator such as a gelling agent, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, a conductive agent and the like may be blended as needed.

In the present step, the emulsion of the elastic polymer is fully impregnated so as to occupy the entire volume of the voids of the first non-woven fabric, and subsequently roll-nip treatment, for example, is performed to squeeze off the emulsion such that the squeezing rate is 30 to 50%. Here, the full impregnation means a state in which the entire volume of the voids of the first non-woven fabric is filled with the emulsion.

By squeezing off the emulsion such that the squeezing rate is 30 to 50% relative to the state in which the first non-woven fabric is fully impregnated with the emulsion, it becomes easy to obtain a napped artificial leather in which the ratio of the area occupied by the elastic polymer, observed on the napped surface, to a total area of the area occupied by the ultrafine fibers and the area occupied by the elastic polymer is 0.5% or less. When the squeezing rate of the emulsion is less than 30%, it becomes difficult to obtain a napped artificial leather in which the ratio of the area occupied by the elastic polymer, observed on the napped surface, to a total area of the area occupied by the ultrafine fibers and the area occupied by the elastic polymer is 0.5% or less. When the squeezing rate of the emulsion exceeds 50%, the shape stability of the resulting napped artificial leather is likely to be reduced, or the abrasion resistance thereof is likely to be reduced.

The content of the elastic polymer contained in the napped artificial leather is not particularly limited, but is preferably 0.1 to 15 mass %, and more preferably 0.5 to 12 mass %, because the dichromatic impression is likely to be suppressed, and the napped artificial leather is also excellent in shape stability, suppleness, and abrasion resistance.

Then, the elastic polymer in the emulsion applied into the voids of the first non-woven fabric is solidified. Examples of the method for solidifying the elastic polymer from the emulsion include a method in which the first non-woven fabric into which the emulsion has been impregnated is dried at about 120 to 170° C. At this time, it is preferable to suppress migration of the emulsion to the surface layer by gelling the emulsion through heat moisture treatment, followed by drying, as necessary.

Then, ultrafine fibers are generated from the ultrafine fiber-generating fibers, to form an artificial leather gray fabric including a second non-woven fabric that is an entangle body of the ultrafine fibers. In the production method of the present embodiment, by removing the sea component from the island-in-the-sea composite fibers of the non-woven fabric of the island-in-the-sea composite fibers, ultrafine fibers are generated to produce an artificial leather gray fabric including the non-woven fabric that is an entangle body of the ultrafine fibers. Examples of the method for removing the sea component from the island-in-the-sea composite fibers include a method in which the non-woven fabric of the island-in-the-sea composite fibers are treated with a solvent or a decomposition agent capable of selectively removing only the sea component. The average fineness of the thus formed ultrafine fibers is 1 dtex or less, preferably 0.005 to 1 dtex, and more preferably 0.1 to 0.5 dtex. When the average fineness of the ultrafine fibers exceeds 1 dtex, the density of the napped surface tends to be reduced, or the flexible texture tends to be degraded. Note that the fineness is calculated by taking a scanning electron microscope (SEM) photograph of a cross section of the obtained napped artificial leather at a magnification of 3000×, measuring the cross-sectional areas of 10 randomly selected fiber cross sections, calculating an average value of the cross-sectional areas, and converting the value into a fineness based on the density of the resin.

The thus obtained artificial leather gray fabric includes a second non-woven fabric that is an entangle body of the ultrafine fibers, and an elastic polymer impregnated into the second non-woven fabric. If necessary, the artificial leather gray fabric may be finished into an artificial leather gray fabric having a predetermined thickness by being sliced in the thickness direction to adjust the thickness thereof.

Then, by buffing at least one side of the artificial leather gray fabric, a napped artificial leather in which the fibers on the surface are napped is obtained. Examples of the buffing method include a method in which buffing is performed using sandpaper or emery paper with a grit number of preferably about 120 to 600, and more preferably about 240 to 600. In this manner, a napped artificial leather having a napped surface on which napped fibers are present on one side or both sides is obtained.

The napped artificial leather may be further subjected to shrinkage processing or flexibilizing treatment by crumpling to impart flexibility for adjusting the texture, or finishing such as reverse seal brushing, antifouling treatment, hydrophilization treatment, lubricant treatment, softener treatment, antioxidant treatment, ultraviolet absorber treatment, fluorescent agent treatment, and flame retardant treatment.

The thus produced napped artificial leather according to the present embodiment is colored, with the pigment (A) blended in the ultrafine fibers, in a dark color such that napped surface has a lightness L* value of 25 or less in a color coordinate space. Usually, the conventional napped artificial leather is colored by being dyed, whereas the napped artificial leather of the present embodiment is an undyed napped artificial leather that is not dyed. Since the napped artificial leather is not dyed, it is possible to omit the dyeing step. Since the elastic polymer is not colored, it is possible to omit the operation of switching the concentrations of the pigment in the emulsion of the elastic polymer for each brand when the napped artificial leather is required to be produced under multiple brands in small quantities. Furthermore, the elastic polymer is not colored, and the napped artificial leather is colored in a dark color with the pigment (A) blended in the ultrafine fibers, and it is therefore possible to obtain a napped artificial leather that is less likely to cause the dye to undergo color migration to another fabric when being rubbed against the other fabric and thus is excellent in dye fastness.

The lightness L* value of the napped surface in a color coordinate space is 25 or less, preferably 21 or less, and more preferably 17 or less, because the effect of the present invention to suppress the glittering becomes prominent.

The thickness of the napped artificial leather produced in the above-described manner is not particularly limited, but is preferably 0.3 to 1.5 mm, and more preferably 0.4 to 1.0 mm. The basis weight of the napped artificial leather is also not particularly limited, but is preferably 150 to 600 g/m$^2$, and more preferably 200 to 500/m$^2$.

Furthermore, the apparent density of the napped artificial leather is also not particularly limited, but is preferably 0.4 to 0.7 g/cm$^3$, and more preferably 0.45 to 0.6 g/cm$^3$, because a napped artificial leather that is excellent in balance between the fullness and the flexible texture can be obtained.

EXAMPLES

Hereinafter, the present invention will be described more specifically by way of examples. It should be appreciated that the scope of the present invention is by no means limited by the examples.

Production Example 1

A water-soluble thermoplastic polyvinyl alcohol (PVA) was used as a sea component, and an isophthalic modified polyethylene terephthalate that had a degree of modification of 6 mol % to which 5 mass % of carbon black had been added was used as an island component. These components were discharged at a spinneret temperature set at 260° C. using a multicomponent melt-spinning spinneret (number of islands: 25 per one island-in-the-sea composite fiber) such that the mass ratio of the sea component/island component was 25/75. Then, the air pressure of an air-jet suction apparatus installed directly below the spinneret was adjusted such that the spinning rate indirectly determined from the ratio of the throughput per unit time and the fineness of the resulting filaments was 3700 m/min, and the polymer discharged from the spinneret was cooled while being drawn out and attenuated. In this manner, island-in-the-sea composite fibers having a fineness of 3.3 dtex were spun. The density of the island-in-the-sea composite fibers was 1.32 g/cm$^3$.

Then, the island-in-the-sea composite fibers were continuously collected on a movable net installed directly below the suction apparatus, and were subsequently pressed using a metal roll having a surface temperature of 60° C., to obtain a web having a basis weight of 30 g/m$^2$.

The obtained web was laid in layers using a cross lapper apparatus so as to have a basis weight corresponding to that of 12 layers of the web, while an oil solution for preventing the needles from breaking was uniformly sprayed onto the web using a spray, thus forming a web stacked body. Then, the web stacked body was needle-punched at a density of 3300 punch/cm$^2$ alternately from both sides at a punching depth of 8.3 mm, using 6-barb needles with a distance of 3.2 mm from the needle tip to the first barb. The area shrinkage due to this needle punching was 70%, and the basis weight of the entangled web after the needle punching was 830 g/m$^2$.

The entangled web was allowed to pass for 30 seconds under a humidity of 50% RH at 70° C. at a take-up line speed of 10 m/min to cause heat-moisture shrinking, thus producing a first non-woven fabric that was an entangle body of the island-in-the-sea composite fibers.

Then, the first non-woven fabric was fully impregnated with an emulsion of polyurethane that was an elastic polymer containing no pigment. The emulsion of the polyurethane was an emulsion containing 15% of a self-emulsified amorphous polycarbonate urethane having a 100% modulus of 3.0 MPa as a solid content, and containing 2.5 mass % of ammonium sulfate as a gelling agent. The density of the emulsion was 1.02 g/cm$^3$. Then, the first non-woven fabric fully impregnated with the emulsion of the polyurethane was allowed to pass through a clearance of a nip roll with a linear load set value of 24 kg/cm, thus squeezing off the emulsion. Here, the roll surface of the nip roll used was formed such that a linear load was applied slightly nonuniformly.

Then, the emulsion after squeezing that had been applied into the first non-woven fabric was gelled by moist heat, and was subsequently dried at 150° C., to solidify the polyurethane. Then, the first non-woven fabric in which the polyurethane had been solidified was repeatedly subjected to dip-nipping in hot water at 95° C. to remove the PVA by dissolution, thus producing a second non-woven fabric in which fiber bundles each including 25 ultrafine fibers having a fineness of 0.1 dtex were three-dimensionally entangled. In this manner, an artificial leather gray fabric in which 10 mass % of the polyurethane had been applied into the voids of the second non-woven fabric was obtained.

Then, the artificial leather gray fabric was halved in the thickness direction, and the surface opposite to the sliced surface was buffed, to form a napped surface. Then, the artificial leather gray fabric with the napped surface formed thereon was subjected to flexibilizing treatment using a jet dyeing machine containing no dye, and was further subjected to drying and brushing, thus obtaining a suede-like napped artificial leather. The obtained napped artificial leather has a thickness of 0.79 to 0.82 mm and a basis weight of 410 to 412 g/m$^2$.

A piece cut out from the vicinity of 10 to 20 cm from one end in the width direction of the napped artificial leather was used as a napped artificial leather of Production Example 1-1, a piece cut out from the vicinity of the center in the linear load direction was used as a napped artificial leather of Production Example 1-2, and a piece cut out from the vicinity of 10 to 20 cm from the other end in the width direction was used as a napped artificial leather of Production Example 1-3. The same applies to the following production examples and comparative production examples.

Production Example 2

A napped artificial leather was obtained in the same manner as in Production Example 1 except that the basis weight of the entangled web was changed to 480 g/m$^2$ by changing the number of layers in which the web was laid when producing the first non-woven fabric, and that the gray fabric was not halved in the thickness direction by slicing. The obtained napped artificial leather had a thickness of 1.03 to 1.06 mm and a basis weight of 520 to 527 g/m$^2$. Then, napped artificial leathers of Production Examples 2-1, 2-2, and 2-3 were produced in the same manner as in Production Example 1.

Production Example 3

A napped artificial leather was obtained in the same manner as in Production Example 1 except that the basis weight of the entangled web was changed to 560 g/m$^2$ by changing the number of layers in which the web was laid when producing the first non-woven fabric, and that the flexibilizing treatment using the jet dyeing machine after buffing was omitted. The obtained napped artificial leather had a thickness of 0.46 to 0.47 mm and a basis weight of 221 to 233 g/m$^2$. Then, napped artificial leathers of Production Examples 3-1, 3-2, and 3-3 were produced in the same manner as in Production Example 1.

Production Example 4

A napped artificial leather was obtained in the same manner as in Production Example 1 except for forming a second non-woven fabric in which fiber bundles each including 25 ultrafine fibers having a fineness of 0.2 dtex were three-dimensionally entangled, instead of forming the second non-woven fabric in which fiber bundles each 25 including ultrafine fibers having a fineness of 0.1 dtex were three-dimensionally entangled. The obtained napped artificial leather had a thickness of 0.82 to 0.83 mm and a basis weight of 411 to 432 g/m$^2$. Then, napped artificial leathers of Production Examples 4-1, 4-2, and 4-3 were produced in the same manner as in Production Example 1.

Production Example 5

A napped artificial leather was obtained in the same manner as in Production Example 1 except that 0.008 mass % of carbon black was blended in the emulsion of the polyurethane relative to a total amount of the carbon black and the polyurethane. The obtained napped artificial leather had a thickness of 0.81 to 0.82 mm and a basis weight of 400 to 420 g/m$^2$. Then, napped artificial leathers of Production Examples 5-1, 5-2, and 5-3 were produced in the same manner as in Production Example 1.

Production Example 6

A napped artificial leather was obtained in the same manner as in Production Example 1 except for using, as the island component, an isophthalic modified polyethylene terephthalate that had a degree of modification of 6 mol % to which 7 mass % of carbon black had been added, instead of using the isophthalic modified polyethylene terephthalate that had a degree of modification of 6 mol % to which 5 mass % of carbon black had been added. The obtained napped artificial leather had a thickness of 0.78 to 0.82 mm and a basis weight of 380 to 412 g/m$^2$. Then, napped artificial leathers of Production Examples 6-1, 6-2, and 6-3 were produced in the same manner as in Production Example 1.

Comparative Production Example 1

A napped artificial leather was obtained in the same manner as in Production Example 1 except that the linear load set value of the squeezing nip roll during impregnation was changed to 10 kg/cm. The obtained napped artificial leather had a thickness of 0.77 to 0.81 mm and a basis weight of 422 to 439 g/m$^2$. Then, napped artificial leathers of Comparative Production Examples 1-1, 1-2, and 1-3 were produced in the same manner as in Production Example 1.

Comparative Production Example 2

A napped artificial leather was obtained in the same manner as in Production Example 2 except that the linear load set value of the squeezing nip roll during impregnation was changed to 10 kg/cm. The obtained napped artificial leather had a thickness of 1.06 to 1.11 mm and a basis weight of 520 to 532 g/m$^2$. Then, napped artificial leathers of Comparative Production Examples 2-1, 2-2, and 2-3 were produced in the same manner as in Production Example 2.

Comparative Production Example 3

A napped artificial leather was obtained in the same manner as in Production Example 1 except that 3.5 mass % of carbon black was blended in the emulsion of the polyurethane relative to a total amount of the carbon black and the polyurethane, and that the linear load set value of the nip roll was changed to 17 kg/cm. The obtained napped artificial leather had a thickness of 0.80 to 0.81 mm and a basis weight of 406 to 408 g/m$^2$. Then, napped artificial leathers of Comparative Production Examples 3-1, 3-2, and 3-3 were produced in the same manner as in Production Example 1.

Comparative Production Example 4

A napped artificial leather was obtained in the same manner as in Production Example 2 except that carbon black was blended in the emulsion of the polyurethane such that the content of the carbon black was 3.5 mass % relative to a total amount of the carbon black and the polyurethane, and that the linear load set value of the nip roll was changed to 17 kg/cm. The obtained napped artificial leather had a thickness of 1.03 to 1.05 mm and a basis weight of 517 to 519 g/m$^2$. Then, napped artificial leathers of Comparative Production Examples 4-1, 4-2, and 4-3 were produced in the same manner as in Production Example 2.

Comparative Production Example 5

Island-in-the-sea composite fibers having a fineness of 3.3 dtex, produced in the same manner as in Production Example 1, were cut into a length of 5 mm, and were subsequently repeatedly subjected to dip-nipping in hot water at 95° C., to remove the PVA by dissolution, whereby spun-dyed polyethylene terephthalate fibers containing 5 mass % carbon black were obtained in the form of fiber bundles each including 25 ultrafine fibers having a fineness of 0.1 dtex. Then, the ultrafine fibers were dispersed in water, and a paper sheet having a basis weight of 50 g/m$^2$ was produced by a papermaking process. Then, the obtained paper sheet was used as a surface fiber layer and a back surface fiber layer, and a gauze-like woven fabric made of polyethylene terephthalate fibers of 82 tex/36 f was inserted as a scrim therebetween, to form a laminate having a three-layer laminated structure, and the laminate was subjected to entangling by high-speed water jetting, to obtain a three-dimensional fiber-entangled body. Then, the three-dimensional fiber-entangled body was dried using a pin tenter. Thus, a non-woven fabric having a basis weight of 200 g/m$^2$ was obtained. Then, the non-woven fabric was fully impregnated with an emulsion of a polyurethane containing no pigment, then allowed to pass through a clearance of a nip roll at a linear load setting of 24 kg/cm, and dried to obtain a sheet-like material. Then, the surface layer of the sheet-like material was buffed in the same manner as in Production Example 1, thus forming a napped surface. Then, the sheet-like material with the napped surface formed thereon was subjected to flexibilizing treatment using a jet dyeing machine containing no dye, and was further subjected to drying and brushing, to obtain a suede-like napped artificial leather. The obtained napped artificial leather had a thickness of 0.86 to 0.98 mm and a basis weight of 420 to 442 g/m$^2$. Then, napped artificial leathers of Comparative Production Examples 5-1, 5-2, and 5-3 were produced in the same manner as in Production Example 2.

Then, the obtained napped artificial leathers were evaluated according to the following evaluation methods.

<Squeezing Rate of Emulsion>

The squeezing rate of the emulsion with which the first non-woven fabric was impregnated was calculated by the following equation.

Apparent density $A$ of first non-woven fabric (g/cm$^3$) =Basis weight of first non-woven fabric (g/m$^2$)/Thickness of first non-woven fabric (mm)/1000

Porosity $B$ (%)=(1−{Apparent density $A$ of first non-woven fabric (g/cm$^3$)/Density of island-in-the-sea composite fibers (1.32) (g/cm$^3$)})×100

Pick-up rate $C$ in fully impregnated state (%)= ({Density of emulsion (1.02) (g/cm$^3$)×Porosity $B$ (%)/100}/Apparent density $A$ of first non-woven fabric (g/cm$^3$))×100

Pick-up rate $D$ after squeezing (%)=((Weight of first non-woven fabric containing emulsion after squeezing−Weight of first non-woven fabric)/Weight of first non-woven fabric)×100

Squeezing rate $E$ (%)=(1−Pick-up rate $D$ after squeezing (%)/Pick-up rate $C$ in fully impregnated state (%))×100

<Ratio of Area Occupied by Elastic Polymer to Total Area of Area Occupied by Ultrafine Fibers and Area Occupied by Elastic Polymer>

The napped surface of each of the napped artificial leathers was brushed in the grain direction using a lint brush. Then, the napped surface was photographed in the range of 12 mm long by 16 mm wide at a magnification of 20×, using a digital microscope (VHX-5000 manufactured by KEYENCE), to obtain an image. Then, the obtained image was subjected to binarized image analysis, thus separating dark color regions developed by the spun-dyed fibers and bright color regions developed as a result of the elastic polymer containing no pigment being exposed on the surface of the artificial leather. Then, the ratio of the area occupied by the elastic polymer to a total area of the area occupied by the ultrafine fibers and the area occupied by the elastic polymer was calculated. Similarly, five locations of the napped surface were evenly photographed, and an average of the five locations was determined.

<Chromaticity>

The chromaticity in the L*a*b* color system of the surface of the cut out napped artificial leather was measured in accordance with JIS Z 8729, using a spectrocolorimeter (Ci62 manufactured by X-Rite Inc.). In addition, the lightness L* was determined from the coordinate values in the L*a*b* color system. The value was an average of the values for three points evenly selected from average positions of the test piece. The smaller the L* value, the darker in color.

<Dichromatic Impression>

Prepared a sample measuring 50 centimeters per side cut out from each of the napped artificial leathers, and a comparison was made with regard to the presence or absence of a dichromatic impression between the sample and the dark black napped artificial leather of Comparative Production Example 3-1, which included the ultrafine fibers containing carbon black and the elastic polymer containing carbon black, by five expert evaluators. Then, the evaluation was made based on the number of the evaluators who determined that the sample had a color tone comparable to that of Comparative Production Example 3-1 and did not have a dichromatic impression.

<Process Contamination>

A: A post-production process was not significantly contaminated due to detachment of the pigment component blended in the emulsion of the polyurethane, and continuous use was possible.

B: A post-production process was significantly contaminated due to detachment of the pigment component blended in the emulsion of the polyurethane, and continuous use was difficult.

The results are shown in Table 1.

TABLE 1

| Example No. | Production Example No. | Pigment concentration (mass%) Elastic polymer | Pigment concentration (mass%) Fibers | Squeezing conditions Nip roll linear load kg/cm | Squeezing conditions Squeezing rate % | Presence or absence of softening processing | Basis weight g/m$^2$ |
|---|---|---|---|---|---|---|---|
| 1 | Prod. Ex. 2-1 | 0 | 5 | 24 | 45% | Present | 527 |
| 2 | Prod. Ex. 3-1 | 0 | 5 | 24 | 45% | Absent | 233 |
| 3 | Prod. Ex. 3-3 | 0 | 5 | 24 | 42% | Absent | 221 |
| 4 | Prod. Ex. 2-3 | 0 | 5 | 24 | 42% | Present | 525 |
| 5 | Prod. Ex. 1-2 | 0 | 5 | 24 | 40% | Present | 410 |
| 6 | Prod. Ex. 2-2 | 0 | 5 | 24 | 39% | Present | 520 |
| 7 | Prod. Ex. 3-2 | 0 | 5 | 24 | 39% | Absent | 228 |
| 8 | Prod. Ex. 1-1 | 0 | 5 | 24 | 37% | Present | 410 |
| 9 | Prod. Ex. 1-3 | 0 | 5 | 24 | 37% | Present | 412 |
| 10 | Prod. Ex. 4-1 | 0 | 5 | 24 | 38% | Present | 411 |
| 11 | Prod. Ex. 4-2 | 0 | 5 | 24 | 36% | Present | 432 |
| 12 | Prod. Ex. 4-3 | 0 | 5 | 24 | 40% | Present | 420 |
| 13 | Prod. Ex. 5-1 | 0.01 | 5 | 24 | 44% | Present | 414 |
| 14 | Prod. Ex. 5-2 | 0.01 | 5 | 24 | 37% | Present | 400 |
| 15 | Prod. Ex. 5-3 | 0.01 | 5 | 24 | 44% | Present | 420 |
| 16 | Prod. Ex. 6-1 | 0 | 7 | 24 | 45% | Present | 380 |
| 17 | Prod. Ex. 6-2 | 0 | 7 | 24 | 40% | Present | 411 |
| 18 | Prod. Ex. 6-3 | 0 | 7 | 24 | 44% | Present | 412 |
| Com. Ex. 1 | Com. Prod. Ex. 2-3 | 0 | 5 | 10 | 33% | Present | 532 |
| Com. Ex. 2 | Com. Prod. Ex. 1-1 | 0 | 5 | 10 | 30% | Present | 439 |
| Com. Ex. 3 | Com. Prod. Ex. 1-3 | 0 | 5 | 10 | 30% | Present | 424 |
| Com. Ex. 4 | Com. Prod. Ex. 1-2 | 0 | 5 | 10 | 28% | Present | 422 |
| Com. Ex. 5 | Com. Prod. Ex. 2-1 | 0 | 5 | 10 | 28% | Present | 530 |
| Com. Ex. 6 | Com. Prod. Ex. 2-2 | 0 | 5 | 10 | 28% | Present | 520 |
| Com. Ex. 7 | Com. Prod. Ex. 3-1 | 3.5 | 5 | 17 | 30% | Present | 406 |
| Com. Ex. 8 | Com. Prod. Ex. 3-2 | 3.5 | 5 | 17 | 36% | Present | 408 |

TABLE 1-continued

| | | | | | | | |
|---|---|---|---|---|---|---|---|
| Com. Ex. 9 | Com. Prod. Ex. 3-3 | 3.5 | 5 | 17 | 39% | Present | 408 |
| Com. Ex. 10 | Com. Prod. Ex. 4-1 | 3.5 | 5 | 17 | 29% | Present | 519 |
| Com. Ex. 11 | Com. Prod. Ex. 4-2 | 3.5 | 5 | 17 | 26% | Present | 517 |
| Com. Ex. 12 | Com. Prod. Ex. 4-3 | 3.5 | 5 | 17 | 28% | Present | 517 |
| Com. Ex. 13 | Com. Prod. Ex. 5-1 | 0 | 5 | 24 | 48% | Present | 420 |
| Com. Ex. 14 | Com. Prod. Ex. 5-2 | 0 | 5 | 24 | 47% | Present | 440 |
| Com. Ex. 15 | Com. Prod. Ex. 5-3 | 0 | 5 | 24 | 47% | Present | 442 |

| | | Evaluation results | | | | | |
|---|---|---|---|---|---|---|---|
| Example | Thickness | Ratio of area occupied by elastic polymer | Dichromatic impression | Chromaticity | | | Process Contamination |
| No. | mm | % | (persons) | L* | a* | b* | A |
| 1 | 1.03 | 0.14 | 5 | 16.50 | 0.64 | 1.27 | A |
| 2 | 0.47 | 0.03 | 5 | 18.60 | 0.74 | 1.42 | A |
| 3 | 0.46 | 0.12 | 5 | 19.60 | 0.78 | 1.51 | A |
| 4 | 1.05 | 0.12 | 5 | 17.20 | 0.66 | 1.21 | A |
| 5 | 0.82 | 0.09 | 5 | 17.30 | 0.68 | 1.20 | A |
| 6 | 1.06 | 0.36 | 5 | 17.20 | 0.69 | 1.29 | A |
| 7 | 0.47 | 0.22 | 5 | 20.10 | 0.79 | 1.56 | A |
| 8 | 0.79 | 0.08 | 5 | 17.60 | 0.65 | 1.14 | A |
| 9 | 0.81 | 0.05 | 5 | 17.20 | 0.63 | 1.20 | A |
| 10 | 0.82 | 0.20 | 5 | 16.20 | 0.59 | 1.23 | A |
| 11 | 0.82 | 0.30 | 5 | 16.60 | 0.67 | 1.25 | A |
| 12 | 0.83 | 0.33 | 5 | 16.90 | 0.66 | 1.10 | A |
| 13 | 0.81 | 0.05 | 5 | 16.50 | 0.70 | 1.11 | A |
| 14 | 0.81 | 0.33 | 5 | 17.30 | 0.80 | 1.12 | A |
| 15 | 0.82 | 0.40 | 5 | 16.00 | 0.54 | 1.09 | A |
| 16 | 0.78 | 0.20 | 5 | 16.50 | 0.60 | 1.34 | A |
| 17 | 0.80 | 0.24 | 5 | 16.80 | 0.65 | 1.11 | A |
| 18 | 0.80 | 0.44 | 5 | 16.60 | 0.49 | 1.30 | A |
| Com. Ex. 1 | 1.07 | 2.45 | 0 | 19.60 | 0.56 | 1.02 | A |
| Com. Ex. 2 | 0.77 | 0.79 | 0 | 21.10 | 0.47 | 0.96 | A |
| Com. Ex. 3 | 0.81 | 1.07 | 0 | 19.60 | 0.56 | 1.02 | A |
| Com. Ex. 4 | 0.79 | 1.40 | 0 | 16.40 | 0.58 | 1.07 | A |
| Com. Ex. 5 | 1.06 | 1.27 | 1 | 21.10 | 0.47 | 0.96 | A |
| Com. Ex. 6 | 1.11 | 0.79 | 0 | 16.40 | 0.58 | 1.07 | A |
| Com. Ex. 7 | 0.81 | 0.06 | (5) | 17.60 | 0.64 | 1.20 | B |
| Com. Ex. 8 | 0.81 | 0.02 | 5 | 17.00 | 0.64 | 1.16 | B |
| Com. Ex. 9 | 0.80 | 0.20 | 5 | 16.60 | 0.64 | 1.17 | B |
| Com. Ex. 10 | 1.03 | 0.33 | 5 | 16.50 | 0.62 | 1.18 | B |
| Com. Ex. 11 | 1.05 | 0.04 | 5 | 17.20 | 0.67 | 1.25 | B |
| Com. Ex. 12 | 1.03 | 0.02 | 5 | 17.20 | 0.64 | 1.13 | B |
| Com. Ex. 13 | 0.90 | 0.88 | 0 | 22.30 | 0.55 | 1.30 | A |
| Com. Ex. 14 | 0.85 | 0.98 | 0 | 21.50 | 0.54 | 1.23 | A |
| Com. Ex. 15 | 0.77 | 0.86 | 0 | 24.40 | 0.48 | 1.34 | A |

The results in Table 1 show that all of the napped artificial leathers of Examples 1 to 18 according to the present invention, in which the ultrafine fibers contained 0.5 mass % or more of a pigment, and the elastic polymer contained 0 to 0.01 mass % of a pigment, the ultrafine fibers and the elastic polymer were undyed, the napped surface has a lightness L* value of 25 or less, and the ratio of an area occupied by the elastic polymer, observed on the napped surface, to a total area of the area occupied by the ultrafine fibers and the area occupied by the elastic polymer was 0.5% or less, had a napped surface without a dichromatic impression despite having a dark color with a lightness L* value of 25 or less, and a post-production process was not also contaminated due to detachment of the pigment component blended in the emulsion of the polyurethane. On the other hand, the napped artificial leathers of Comparative Examples 1 to 6 and 13 to 15, in which the ratio of the area occupied by the elastic polymer to a total area of the area occupied by the ultrafine fibers and the area occupied by the elastic polymer exceeded 0.5%, were determined to be napped surfaces with a dichromatic impression. In addition, the napped artificial leathers of Comparative Examples 7 to 12, in which a pigment in an amount that provided coloration was blended in the emulsion of the elastic polymer, a post-production process was contaminated due to detachment of the pigment component blended in the emulsion of the polyurethane.

INDUSTRIAL APPLICABILITY

A napped artificial leather obtained according to the present invention can be suitably used as a skin material for clothing, shoes, articles of furniture, car seats, general merchandise, and the like.

The invention claimed is:

1. A napped artificial leather, comprising:

a non-woven fabric comprising an entangled body of ultrafine fibers; and an elastic polymer impregnated into the non-woven fabric;

wherein:

the napped artificial leather comprises, at least on one side thereof, a napped surface formed by napping the ultrafine fibers;

the ultrafine fibers comprise a pigment (A) in an amount of 0.5 mass % or more;

the elastic polymer comprises a positive amount of a pigment (B) in an amount up to 0.01 mass %;

the ultrafine fibers and the elastic polymer are undyed;

the napped surface has a lightness value of 25 or less in a color coordinate space (L*a*b* color space); and a ratio of an area occupied by the elastic polymer observed on the napped surface to a total area of an area occupied by the ultrafine fibers observed on the napped surface and the area occupied by the elastic polymer observed on the napped surface is 0.5% or less.

2. The napped artificial leather according to claim 1, wherein the ultrafine fibers comprise the pigment (A) in an amount of 0.5 to 10 mass %.

3. The napped artificial leather according to claim 1, wherein the ultrafine fibers comprise the pigment (A) in an amount of 1.5 to 7 mass %.

4. The napped artificial leather according to claim 1, wherein the napped artificial leather comprises the elastic polymer in an amount of 0.1 to 15 mass %.

5. The napped artificial leather according to claim 1, wherein the ultrafine fibers have a fineness of 1 dtex or less.

6. The napped artificial leather according to claim 1, wherein the lightness L* value is 21 or less.

7. A method for producing the napped artificial leather according to claim 1, comprising:

preparing a first non-woven fabric comprising an entangled body of ultrafine fiber-generating fibers for forming the ultrafine fibers;

fully impregnating, into voids of the first non-woven fabric, an emulsion for forming the elastic polymer, and subsequently removing a part of the emulsion by squeezing off;

solidifying the elastic polymer in the emulsion applied into the voids of the first non-woven fabric;

forming the ultrafine fibers from the ultrafine fiber-generating fibers to form an artificial leather gray fabric including a second non-woven fabric comprising an entangled body of the ultrafine fibers; and buffing at least one side of the artificial leather gray fabric;

wherein a squeezing rate at which a part of the emulsion is squeezed off is 30 to 50%.

8. The method according to claim 7, wherein the emulsion further comprises a gelling agent.

9. The napped artificial leather according to claim 1, wherein:

the ratio of the area occupied by the elastic polymer observed on the napped surface to a total area of the area occupied by the ultrafine fibers observed on the napped surface and the area occupied by the elastic polymer observed on the napped surface is 0.4% or less;

the ultrafine fibers comprise the pigment (A) in an amount of 0.5 to 10 mass %;

the napped artificial leather comprises the elastic polymer in an amount of 0.1 to 15 mass %;

the ultrafine fibers have a fineness of 0.1 to 0.5 dtex;

the lightness L* value is 21 or less;

the napped artificial leather has a thickness of 0.3 to 1.5 mm; and the napped artificial leather has an apparent density of 0.4 to 0.7 g/cm$^3$.

* * * * *